US006765538B2

(12) United States Patent
Fang

(10) Patent No.: US 6,765,538 B2
(45) Date of Patent: Jul. 20, 2004

(54) DUAL BAND SLOT ANTENNA

(75) Inventor: Chien-Hsing Fang, Taipei Hsien (TW)

(73) Assignee: Wistron NeWeb Corp., Taipei Hsien (TW)

( * ) Notice: Subject to any disclaimer, the term of this patent is extended or adjusted under 35 U.S.C. 154(b) by 41 days.

(21) Appl. No.: 10/054,867

(22) Filed: Jan. 25, 2002

(65) Prior Publication Data

US 2002/0171594 A1 Nov. 21, 2002

(30) Foreign Application Priority Data

May 17, 2001 (TW) ..... 90111861 A

(51) Int. Cl.[7] ..... H01Q 13/10
(52) U.S. Cl. ..... 343/770; 343/702; 343/767
(58) Field of Search ..... 343/700 MS, 702, 343/767, 770, 829, 846

(56) References Cited

U.S. PATENT DOCUMENTS 3,577,196 A * 5/1971 Pereda ..... 343/770
4,692,769 A * 9/1987 Gegan ..... 343/700 MS
5,012,255 A * 4/1991 Becker ..... 343/704
5,600,337 A * 2/1997 Cassel ..... 343/770
5,754,143 A * 5/1998 Warnagiris et al. ..... 343/767
6,407,715 B1 * 6/2002 Chen ..... 343/767
6,414,642 B2 * 7/2002 Honda et al. ..... 343/702

FOREIGN PATENT DOCUMENTS

| | | |
|---|---|---|
| EP | 0701296 | 3/1996 |
| JP | 5-7110 | 1/1993 |

* cited by examiner

*Primary Examiner*—Tho Phan
(74) *Attorney, Agent, or Firm*—Bacon & Thomas, PLLC

(57) ABSTRACT

An antenna structure in the shape of a conducting plate for radiating and receiving electromagnetic signals and having a first opening for producing electromagnetic resonance at a first frequency band and a second opening for producing electromagnetic resonance at a second frequency band. A coaxial cable is used to feed signals of both frequency bands to the antenna across the first opening. The first opening can be on a deflected part of the conducting plate relative to the second opening.

10 Claims, 5 Drawing Sheets

DUAL BAND SLOT ANTENNA

REFERENCE TO FOREIGN APPLICATIONS

The applicant of the present application claims priority date of related Taiwan application No. 090111861 filed at May 17, 2001, and entitled "Dual Band Slot Antenna."

BACKGROUND OF THE INVENTION

1. Field of the Invention

The present invention relates to a dual band antenna, and more particularly, to a dual band slot antenna containing two slots for creating resonance within distinct frequency bands.

2. Description of the Prior Art

Wireless transmission has become a required function for today's mobile devices, such as laptop computers and handhelds. FIG. 1 illustrates a typical planar slot antenna for use in a mobile device for transmitting and receiving wireless signals. Slot antenna 1 includes a conducting plate 10 in which an elongate opening or slot 11 is formed. A coaxial cable 14 is connected to the conducting plate 10 by connecting the inner conductor to feed point 12 and connecting the outer conductor to ground 13. When situated in electromagnetic fields, electric currents will be induced on the conducting plate 10 and resonance is created along the slot 11. The induced currents carry encoded signals according to the protocol utilized for wireless transmission and are collected and received at feed point 12 by the coaxial cable 14 for further decoding.

Similarly, when the coaxial cable 14 feed encoded signals to the conducting plate 10 through feed point 12, electric currents are generated on the conducting plate 10 and resonance is created along the slot 11 so that electromagnetic waves carrying the encoded signals can be radiated away. As a general rule, the longer is the slot 11, the lower is the resonance frequency, and vice versa. By adjusting the shape and dimension of the slot 11, one is able to have the slot antenna 1 function within a desired frequency range according to protocol specification.

Currently there are several protocols available for establishing wireless transmission, each utilizing a particular frequency band. For example, Bluetooth and IEEE 802.11b both operate at 2.4 GHz, while GPRS operates at 900 MHz and 1800 MHz, and IEEE 802.11a at 5.5 GHz. Although the prior art slot antenna 1 illustrated in FIG. 1 can be made to operate at a wide variety of frequency ranges, it can only function for one particular frequency range at one time. That is, the slot antenna 1 is a monoband antenna and is therefore limited in its application. It is needed in this regard to have a dual band slot antenna that can transmit and receive signals of two frequency bands.

SUMMARY OF THE INVENTION

It is therefore a primary objective of the claimed invention to provide a dual band planar slot antenna to overcome the above-mentioned shortcoming of the prior art.

According to one embodiment of the claimed invention, the antenna comprises a metallic plate having two elongate slots. The first slot and the second slot are longitudinally parallel and close to each other. A coaxial cable feeds signals across the first slot. A securing structure securely and precisely fixes the coaxial cable onto the metallic plate at a desired position. The first slot and the second slot are electrically connected to the coaxial cable so that, by sharing the same feed, the first slot is used to transmit and receive radio signals of a first frequency band and the second slot is used to transmit and receive radio signals of a second frequency band.

According to another embodiment of the claimed invention, the antenna comprises a metallic plate having two elongate slots formed in oblique surfaces respectively.

These and other objectives of the claimed invention will no doubt become obvious to any skilled artist in this field after reading the following detailed description of the preferred embodiment that is illustrated in the various figures and drawings.

DETAILED DESCRIPTION OF THE PREFERRED EMBODIMENT

Figure 1:
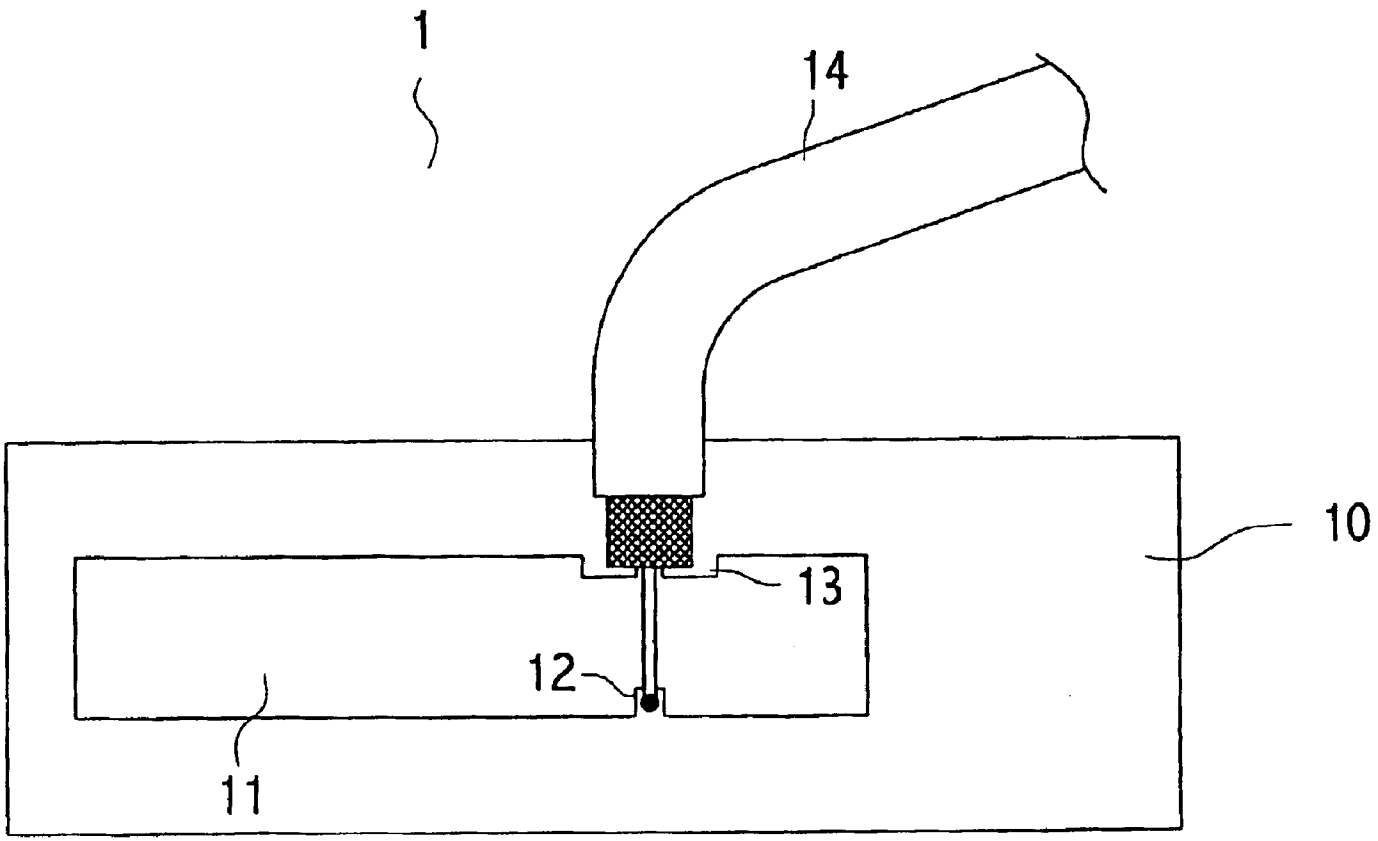
Fig. 1 ( PRIOR ART )
FIG. 1 is a frontal view of a planar slot antenna according to the prior art.
Figure 2:
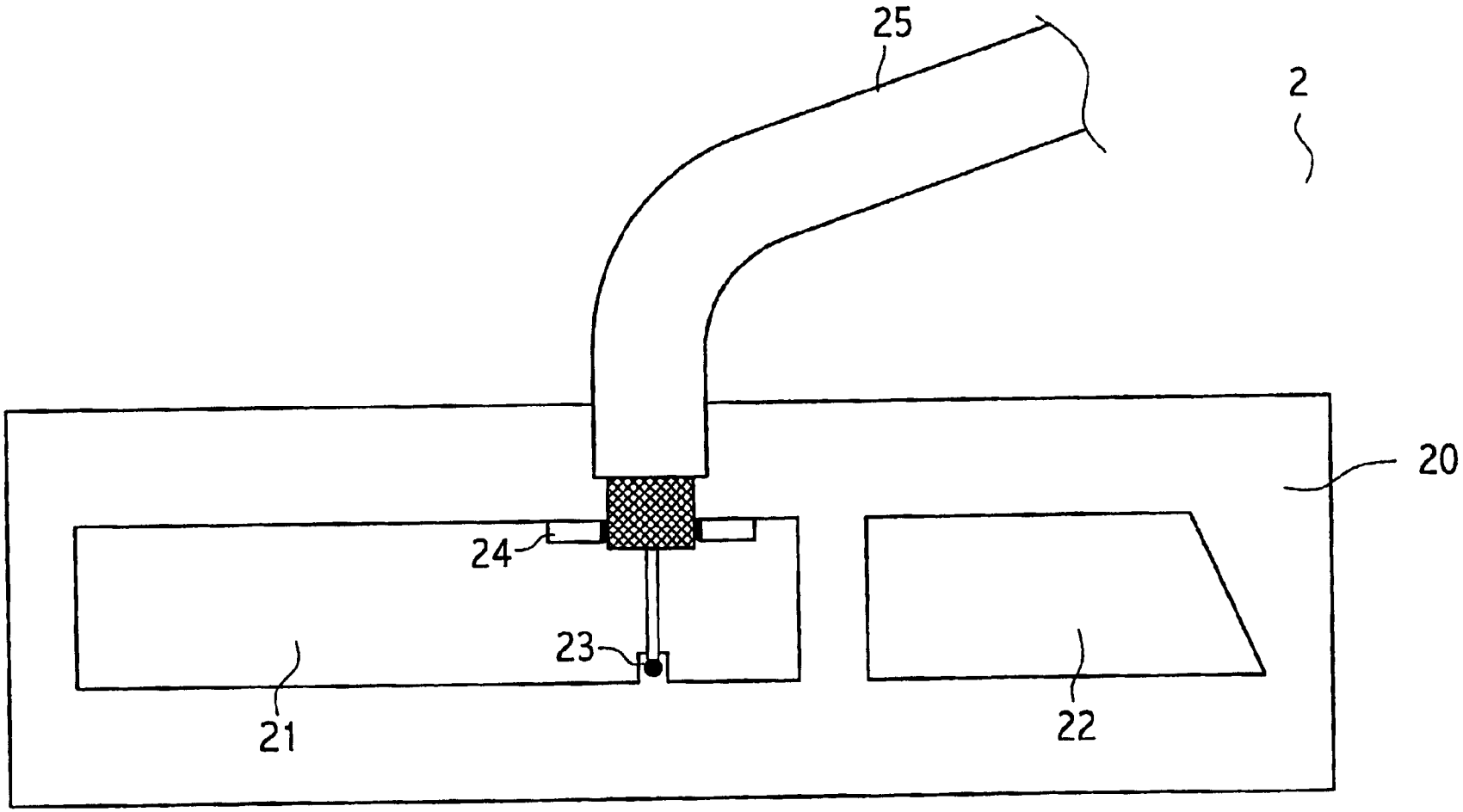
FIG. 2 is a frontal view of a dual band planar slot antenna according to the first embodiment of the present invention.

FIG. 2 is a frontal view of a dual band planar slot antenna according to the first embodiment of the present invention. The dual band slot antenna 2 consists of a conducting plate 20 in which a long slot 21 and a short slot 22 are formed. The long slot 21 is endowed with a characteristic length that provides resonance path for electromagnetic fields in a lower frequency band, and similarly the short slot 22 is endowed with a characteristic length that provides resonance path for electromagnetic fields in a higher frequency band. Preferably the conducting plate 20 elongates in a longitudinal direction along which the long slot 21 and the short slot 22 are both aligned. In the present embodiment the conducting plate 20 and the long slot 21 are rectangular, and the short slot 22 is trapezoid. The difference between a rectangular slot and a trapezoid slot is that a rectangular slot provides substantially one resonance length that results in a narrow bandwidth. But a trapezoid slot provides different resonance lengths reflected in its outline so that wider bandwidth can be obtained. A skilled artist in this field should observe that the conducting plate 20, the long slot 21 and the short slot 22 can have outlines other than those shown in FIG. 2.

The dual band slot antenna 2 further consists of a coaxial cable 25 for feeding signals. In the present embodiment, the coaxial cable 25 feeds directly across the long slot 21. This is done by connecting or welding the inner conductor and outer conductor of the coaxial cable 25 to the feed point 23 and the ground 24 of the slot antenna 2, respectively. When the cable 25 feeds the lower frequency band signals into the conducting plate 20, lower frequency resonance is created around the long slot 21 and electromagnetic waves carrying wireless signals are radiated away. By the same token, when the cable 25 feeds the higher frequency band signals into the conducting plate 20, higher frequency resonance is created around the short slot 22 that couples to the cable 25 and electromagnetic waves carrying wireless signals are radiated away.

Figure 3:
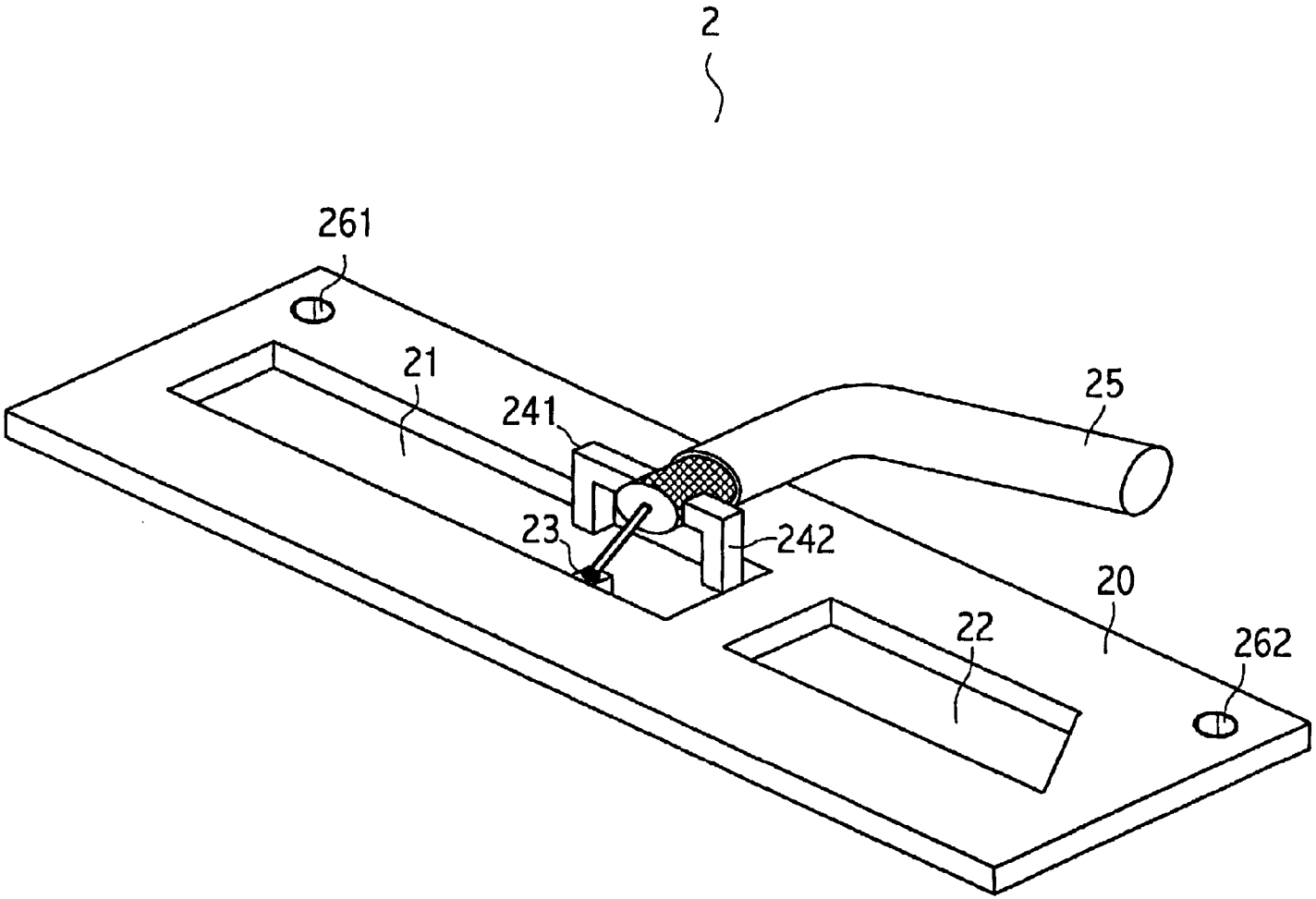
FIG. 3 is a perspective view of the dual band planar slot antenna in FIG. 2 according to the first embodiment of the present invention.

FIG. 3 is a perspective view of the dual band planar slot antenna of FIG. 2 according to the first embodiment of the present invention. For the purpose of securely fixing the coaxial cable 25 onto the conducting plate 20, two supporting arms 241 and 241 are disposed on opposite sides of the outer conductor of the coaxial cable 25. The supporting arms 241 and 242 create a recession between them for receiving and precisely positioning the outer conductor on the ground 24. This is advantageous because a precise positioning of the cable 25 on ground 24 and feed point 23 greatly reduces variations in impedance and other antenna characteristics that may occur during manufacturing process if the cable 25 is displaced out of the desired contact points with the conducting plate 20. Furthermore, at the corners of the conducting plate 20 are disposed a pair of opening 261 and 262 that are used for mounting the antenna 2 onto mobile devices using fasteners such as screws or bolts.

Figure 4:
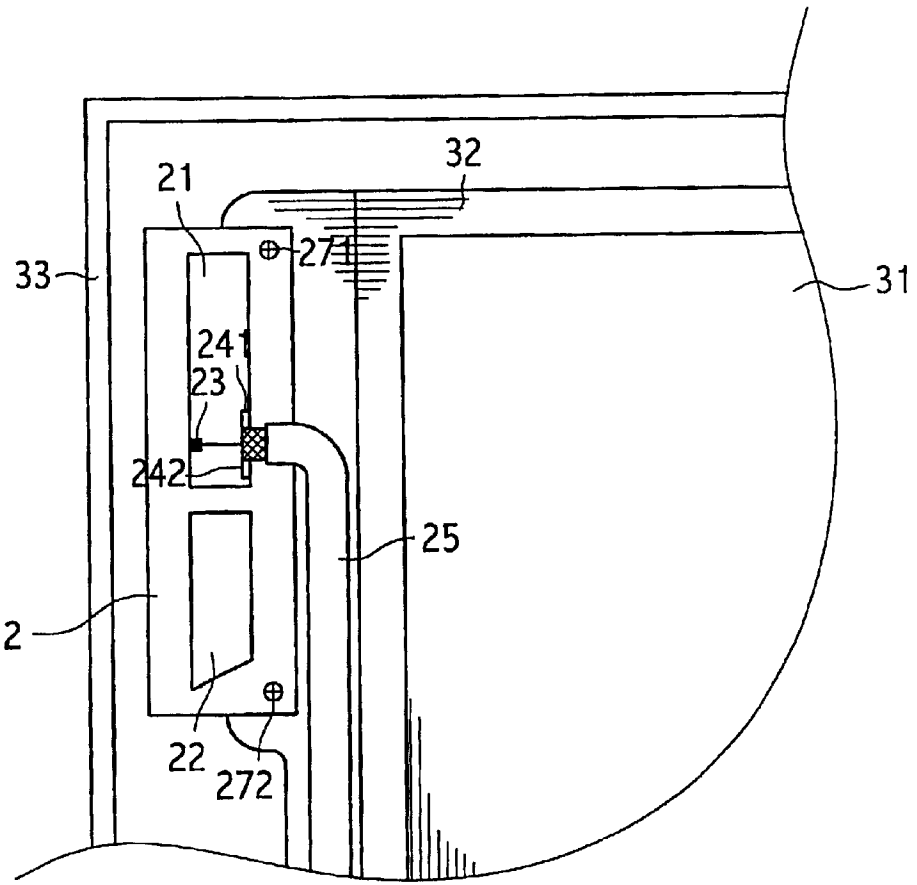
FIG. 4 illustrates one example of installation of the dual band planar slot antenna 2 in a LCD panel of a laptop computer system of which only a part of the display is shown for simplicity. The liquid crystal display 31 is confined within the covering 33 of the LCD panel. A bracket 32 surrounds the display 31 and buttresses it as a structural support for providing rigidity to the covering 33 and the liquid crystal display 31 as a whole. The dual band slot antenna 2 is mounted on the bracket 32 at the left edge of the display 31 using screws 271 and 272 and thereby makes use of the space available between the covering 33 and the display 31. Through in this example the dual band slot antenna 2 is embedded in the LCD panel, it is general knowledge of a skilled artist that the present invention is installable and applicable to other devices in other settings.

FIG. 4 illustrates one example of installation of the dual band planar slot antenna 2 in a LCD panel of a laptop computer system of which only the display part is shown for simplicity. The liquid crystal display 31 is confined within the covering 33 of the LCD panel. A bracket 32 surrounds the display 31 and buttresses it as a structural support for providing rigidity to the covering 33 and the liquid crystal display 31 as a whole. The dual band slot antenna 2 is mounted on the bracket 32 at the left edge of the display 31 using screws 271 and 272 and thereby makes use of the space available between the covering 33 and the display 31. Though in this example the dual band slot antenna 2 is embedded in LCD panel, it is general knowledge of a skilled artist that the present invention is installable and applicable to other devices in other settings.

Figure 5:
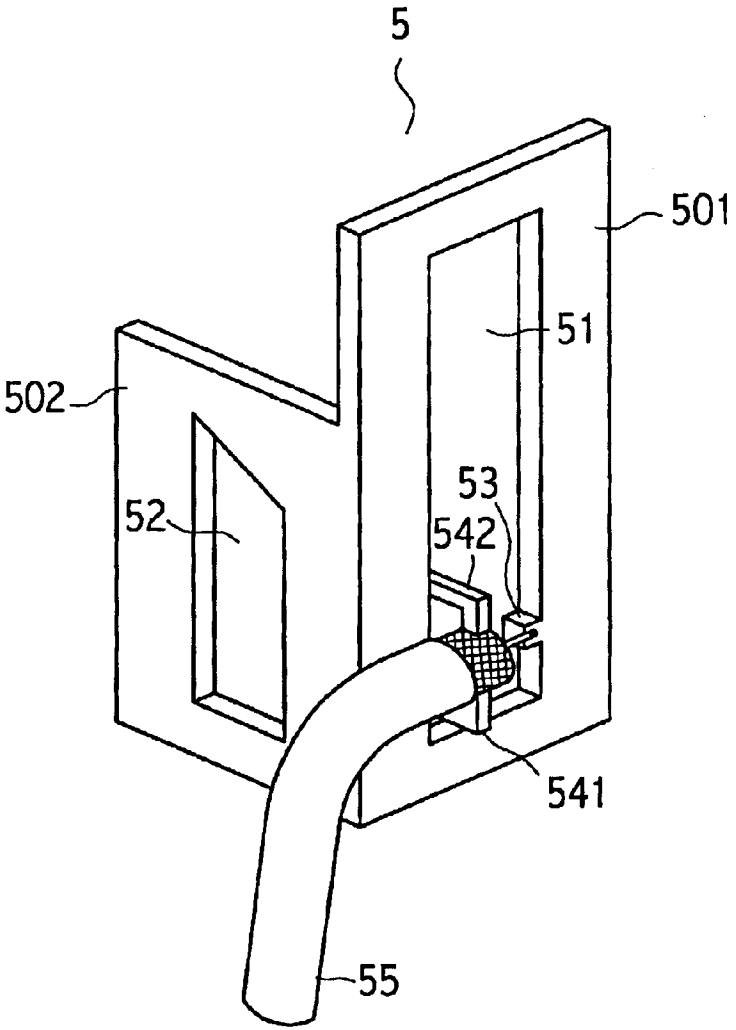
FIG. 5 is a perspective view of a dual band planar slot antenna according to the second embodiment of the present invention.

FIG. 5 is a perspective view of a dual band planar slot antenna according to the second embodiment of the present invention. The slot antenna 5 consists of conducting surfaces 501 and 502, one deflected or oblique in relation to the other. The long slot 51 which corresponds to lower frequency band is located in the conducting surface 501, and the short slot 52 corresponding to higher frequency band is located in the conducting surface 502. A coaxial cable 55 feeds signals across the long slot 51 into feed point 53 with the help of two supporting arms 541 and 542. As can be discerned, the slot antenna 5 functions in the same way as to that of the slot antenna 2 of the first embodiment, except that in the second embodiment the long slot 51 and the short slot 52 lie in different surfaces at an angle to each other. The deflection or deformation of the antenna 5 offers possibility and flexibility of placement in limited installation space available in compact mobile devices. In addition to the characteristic lengths of the long slot 51 and the short slot 52, the deflection angle between surfaces 501 and 502 also counts as a factor determining the resonance frequencies of the dual band antenna 5. By adjusting the dimensions of the slots and the deflection angle, a skilled artist can construct a dual band slot antenna with a wide variety of frequency combinations.

A skilled artist will readily observe that numerous modifications and alterations of the embodiments may be made while retaining the teachings of the invention. Accordingly, the above disclosure should not be construed in a limiting sense and the true scope of the invention is determined only by the appended claims.

What is claimed is:

1. A dual band antenna for a wireless communication system, comprising:

a conducting surface for radiating and receiving electromagnetic signals and having a first cutout part having a longitudinal axis and a second cutout part having a longitudinal axis, said first cutout part having a length for producing electromagnetic resonance at a first frequency range, and said second cutout part having a length for producing electromagnetic resonance at a second frequency range, the longitudinal axis of the first cutout part being substantially aligned with the longitudinal axis of the second cutout part;

a feed point connected with said conducting surface around said first cutout part for feeding signals of said first frequency range to said first cutout part and for feeding signals of said second frequency range to said second cutout part;

a coaxial cable connected with said conducting surface at said feed point for feeding signals to said dual band antenna;

a grounding location formed on said conducting surface around said first cutout part whereby said coaxial cable is grounded; and a fixation structure disposed on said conducting surface around said grounding location, said fixation structure having a recess receiving said coaxial cable for providing precise fixation and grounding of said coaxial cable.

2. The dual band antenna of claim 1, wherein said first cutout part and said second cutout part lie in the same plate of said conducting surface.

3. The dual band antenna of claim 1, wherein said first cutout part and said second cutout part elongate substantially in the same direction on said conducting surface.

4. A dual band antenna for a wireless communication system, comprising:

a conducting surface for radiating and receiving electromagnetic signals and having a first cutout part having a longitudinal axis and a second cutout part having a longitudinal axis, said first cutout part having a length for producing electromagnetic resonance at a first frequency range, and said second cutout part having a length for producing electromagnetic resonance at a second frequency range, the longitudinal axis of the first cutout part being substantially aligned with the longitudinal axis of the second cutout part;

a feed point connected with said conducting surface around said first cutout part for feeding signals of said first frequency range to said first cutout part and for feeding signals of said second frequency range to said second cutout part; and a feed line connected with said conducting surface at said feed point for feeding signals to said dual band antenna, wherein said first cutout art is rectangular and said second cutout part is trapezoidal.

5. An antenna structure for a wireless communication system, comprising:

a conducting plate for radiating and receiving electromagnetic signals and having a first opening and a second opening, said first opening being rectangular for producing electromagnetic resonance at a first frequency band, and said second opening being trapezoidal for producing electromagnetic resonance at a second frequency band; and a feed line connected with said conducting plate around said first opening for feeding signals of said first frequency band of said first opening and for feeding signals of said second frequency band of said second opening.

6. The antenna structure of claim 5, wherein said first opening is on a deflected part of said conducting plate relative to said second opening.

7. A dual band antenna for a wireless communication system, comprising:

a conducting surface for radiating and receiving electromagnetic signals and having a first cutout part and a second cutout part, said first cutout part having a length for producing electromagnetic resonance at a first frequency range, and said second cutout part having a length for producing electromagnetic resonance at a second frequency range;

a feed point connected with said conducting surface around said first cutout part for feeding signals of said first frequency range to said first cutout part and for feeding signals of said second frequency range to said second cutout part;

a feed line connected with said conducting surface at said feed point for feeding signals to said dual band antenna;

a grounding location formed on said conducting surface around said first cutout part whereby said feed line is grounded; and a fixation structure disposed on said conducting surface around said grounding location, said fixation structure having a recess receiving said feed line for providing precise fixation and grounding of said feed line.

8. A dual band antenna for a wireless communication system, comprising:

a conducting surface for radiating and receiving electromagnetic signals and having a first cutout part and a second cutout part, said first cutout part having a length for producing electromagnetic resonance at a first frequency range, and said second cutout part having a length for producing electromagnetic resonance at a second frequency range;

a feed point connected with said conducting surface around said first cutout part for feeding signals of said first frequency range to said first cutout part and for feeding signals of said second frequency range to said second cutout part; and a feed line connected with said conducting surface at said feed point for feeding signals to said dual band antenna, wherein at least one of said first cutout part and said second cutout part is trapezoidal.

9. The dual band antenna of claim 4, wherein said first cutout part and said second cutout part lie in the same plate of said conducting surface.

10. The dual band antenna of claim 4, wherein said first cutout part and said second cutout part elongate substantially in the same direction on said conducting surface.

* * * * *